United States Patent [19]

Hildebrand et al.

[11] 4,030,604

[45] June 21, 1977

[54] FOLDABLE SUPPORT MEMBER AND BLANK THEREFOR

[75] Inventors: Larry R. Hildebrand, Center Valley; John F. Carpenter, Lancaster, both of Pa.

[73] Assignee: Packaging Corporation of America, Evanston, Ill.

[22] Filed: Mar. 5, 1976

[21] Appl. No.: 664,410

[52] U.S. Cl. ..... 206/521; 206/45.19; 229/14 C

[51] Int. Cl.[2] ..... B65D 81/04

[58] Field of Search ..... 206/45.19, 521; 229/14 C, 23 A; 108/51.3; 248/346

[56] References Cited

UNITED STATES PATENTS

| | | | |
|---|---|---|---|
| 1,728,894 | 9/1929 | Oppenheim | 206/521 X |
| 2,176,274 | 10/1939 | Parnin | 229/14 C |
| 2,314,491 | 3/1943 | Greenberg | 229/14 C |
| 2,803,336 | 8/1957 | Stotz | 229/14 C X |
| 3,220,632 | 11/1965 | Persson | 229/14 C |
| 3,294,226 | 12/1966 | McFarland et al. | 229/14 C X |
| 3,587,836 | 6/1971 | Brown | 206/45.19 X |

*Primary Examiner*—Stephen P. Garbe
*Attorney, Agent, or Firm*—Neuman, Williams, Anderson & Olson

[57] ABSTRACT

A support member is provided which is formed from a single blank of foldable sheet material. The support member includes a top panel which is adapted to subtend and supportingly engage an object. Spaced beneath the top panel and in registered relation therewith is a pair of intermediate panels arranged in substantially coplanar relation. Each intermediate panel is connected to a corresponding edge of the top panel by a side wall. Subtending the intermediate panels and foldably connected thereto are base panels arranged in substantially coplanar relation. Foldably connected to the top panel is a tuck flap which has a portion thereof frictionally sandwiched between the intermediate panels and the base panels.

16 Claims, 12 Drawing Figures

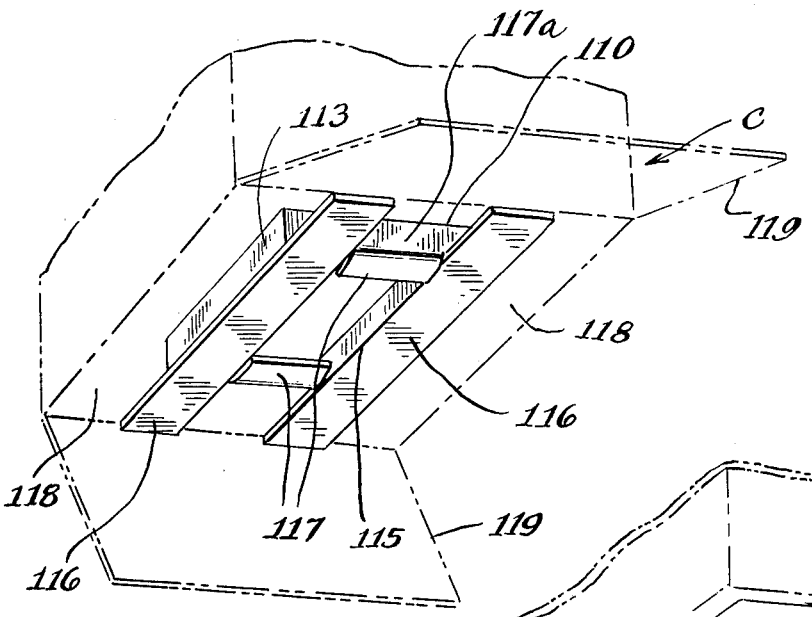
Fig. 9.
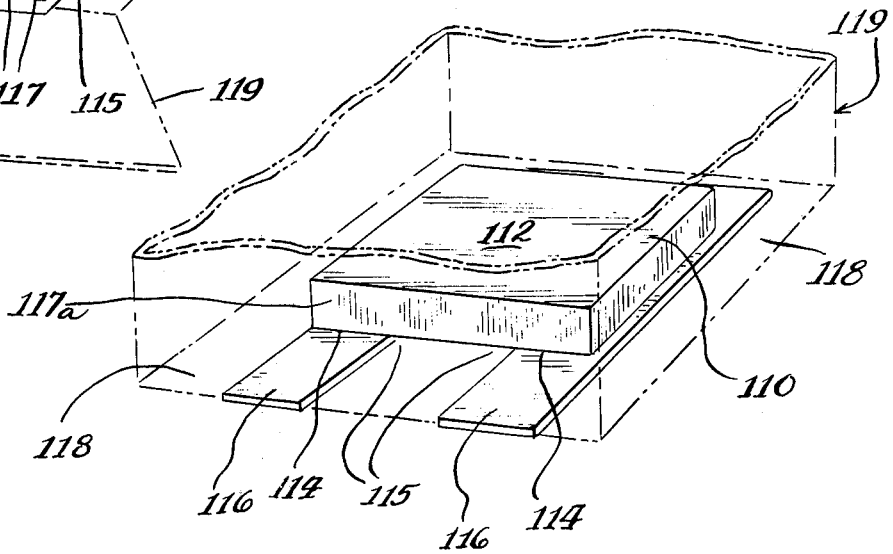
Fig. 8.
Fig. 7.
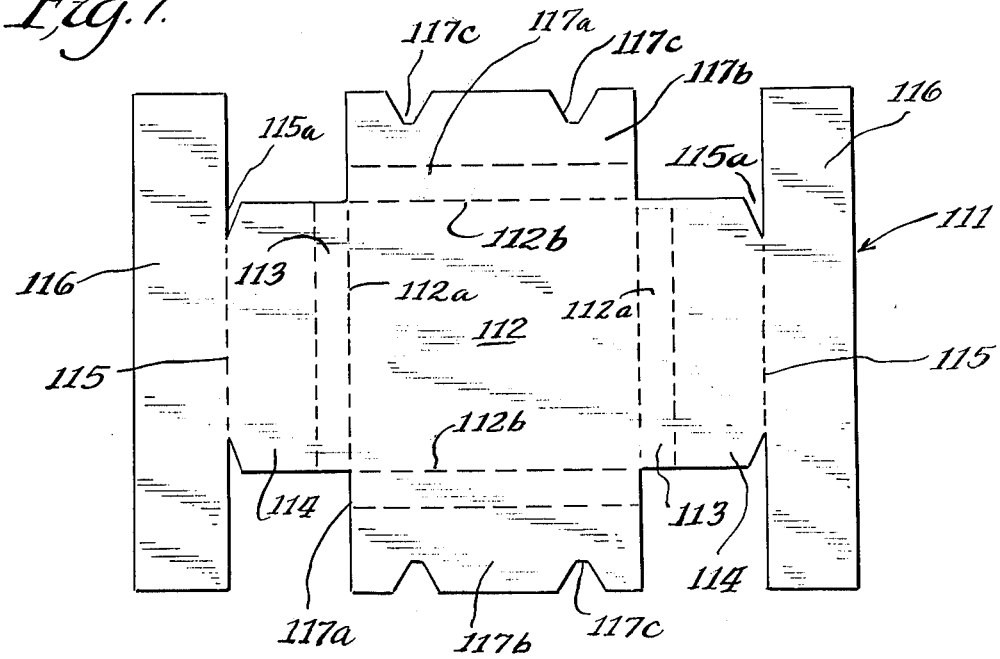

Fig. 10.
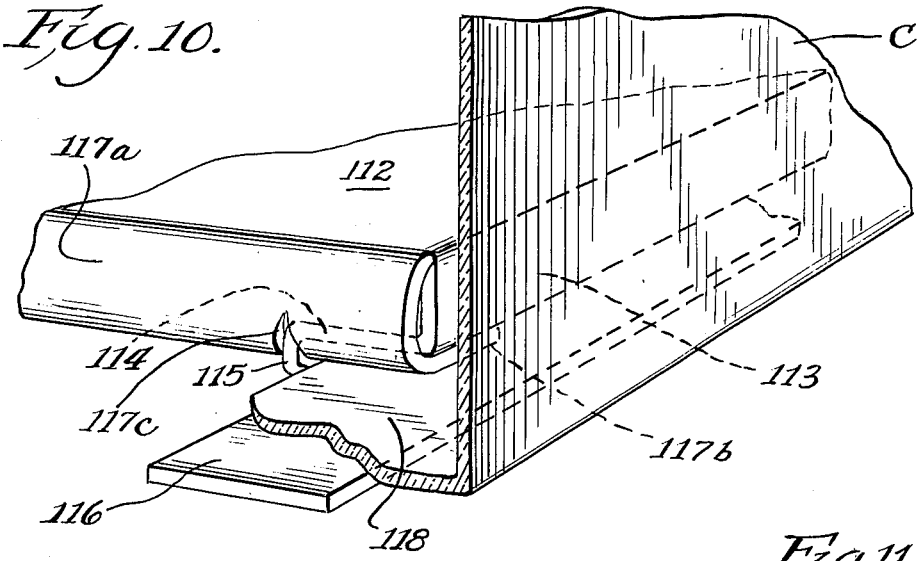
Fig. 11.
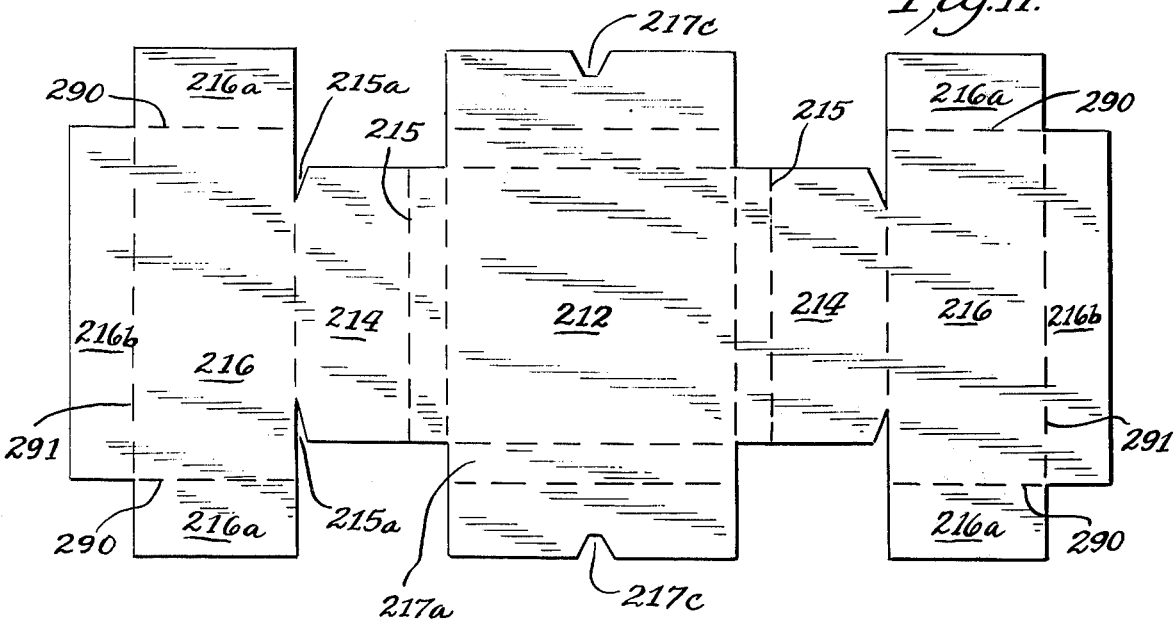
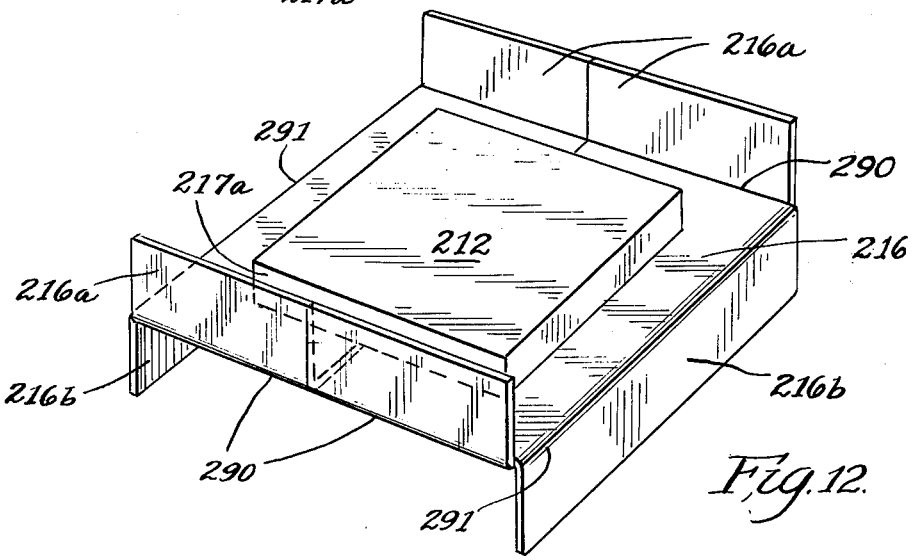
Fig. 12.

FOLDABLE SUPPORT MEMBER AND BLANK THEREFOR

BACKGROUND OF THE INVENTION

In the packaging for shipping of various fragile objects, such as lamp bases or the like, it is important that the object be centered and/or in spaced relation with the sides, top and bottom of the shipping container accommodating the object. Heretofore, to accomplish the desired result, it was necessary to utilize substantial amounts of various types of inner packing materials which were either expensive, required the use of special tools or machines, or were difficult to inventory. Furthermore, certain of the inner packing materials were not suitable for use in maintaining the required bottom clearance for the object because after a short period of time the material lost its resilience and/or tended to compact.

SUMMARY OF THE INVENTION

Thus, it is an object of the invention to provide a support member for an object which is of simple, inexpensive construction, is capable of being stored in a collapsed state, and may be readily set up when required.

It is a further object of the invention to provide a support member for an object which is formed from a single blank of foldable sheet material and does not require the utilization of special tools, adhesive, tape or the like, to set up or to maintain in a set-up condition.

It is a still further object of the invention to provide a support member which is capable of accommodating a variety of objects.

It is a further object of the invention to provide a support member which coacts with the minor flaps of a shipping container to effect proper positioning of the support member therein.

It is yet another object of the invention to provide a support member capable of assuming a predetermined vertical placement within a shipping container.

Further and additional objects will appear from the description, accompanying drawings, and appended claims.

In accordance with one embodiment, a foldable support member is provided which is adapted to be formed from a single blank of sheet material. The member includes a top panel which is adapted to subtend and engage an object. Disposed on opposite sides and foldably connected to first peripheral segments of the top panel is a pair of side walls. Foldably connected to the side walls and disposed in spaced relation beneath the top panel is a pair of intermediate panels arranged in coplanar relation. Subtending the intermediate panels arranged in coplanar relation. Subtending the intermediate panels and arranged in coplanar relation is a pair of base panels. Foldably connected to a second peripheral segment of the top panel which is intermediate the first peripheral segments is a tuck flap. The tuck flap has a portion thereof which is frictionally sandwiched between the intermediate panels and the base panels.

DESCRIPTION

For a more complete understanding of the invention reference should be made to the drawings wherein:

FIG. 7 is similar to FIG. 1 but showing a second form of a blank for use in setting up a second embodiment of the improved support member.

FIG. 8 is a perspective top view of the second embodiment of the improved support member shown disposed within a shipping container, the latter being in phantom lines.

FIG. 9 is a perspective bottom view of the support member of FIG. 8 and showing in phantom lines the shipping container with the minor closure flaps thereof coacting with the support member and the major closure flaps unfolded.

FIG. 10 is an enlarged fragmentary perspective bottom corner view of the support member of FIG. 8 and with the shipping container in full lines but broken away so as to show more clearly the coaction between the support member and one of the minor closure flaps of the shipping container.

FIG. 11 is similar to FIG. 7 but showing a third form of a blank for use in setting up a third embodiment of the improved support member.

FIG. 12 is a perspective top view of the third embodiment of the improved support member.

Figure 5:
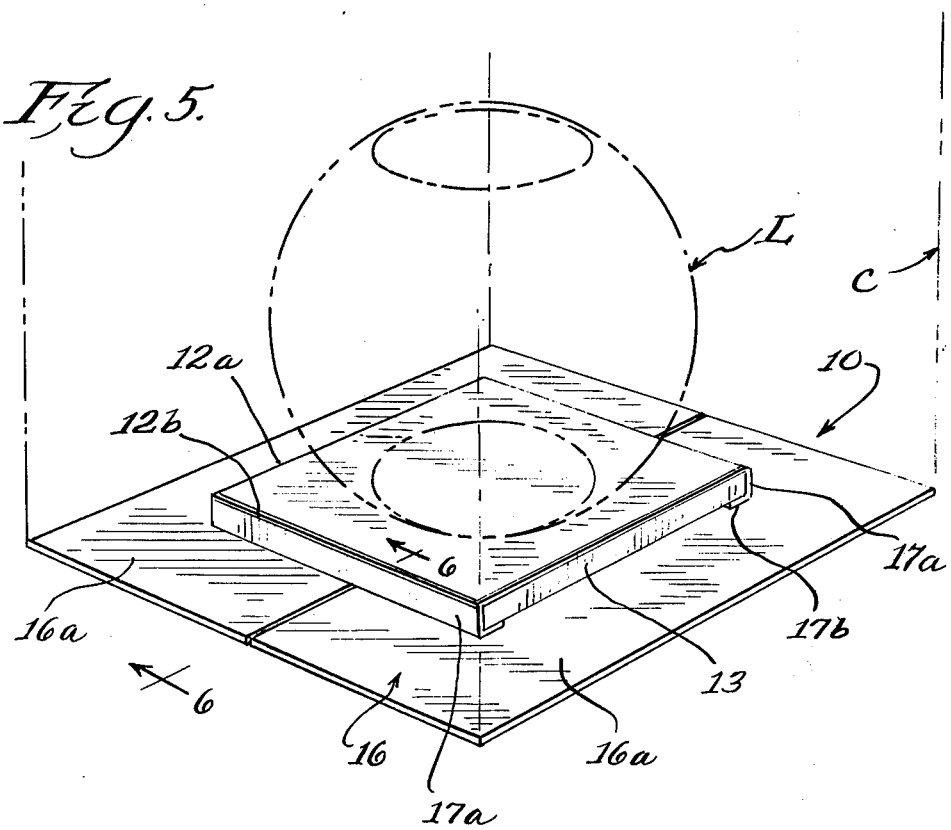
FIG. 5 is perspective view of the blank of FIG. 1 in a fully set-up condition and showing in phantom lines an object being supported thereby and a shipping container accommodating the support member and object.

Referring now to the drawings and more particularly to FIG. 5, one form of the improved support member 10 is shown disposed within a conventional shipping container C and supporting a fragile object, such as a lamp base L or the like.

Figure 4:
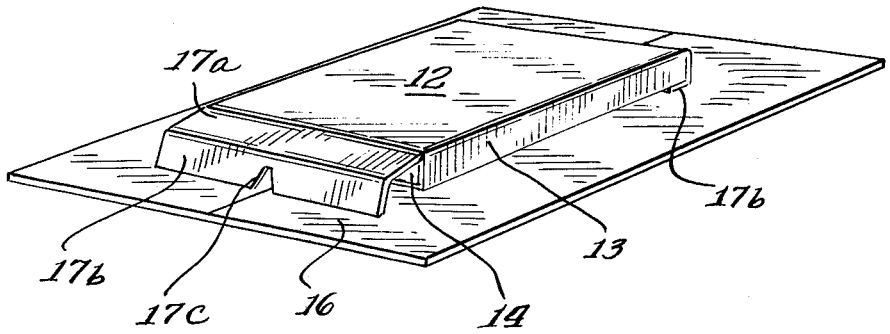
FIG. 4 is similar to FIG. 3 but in an inverted position.

The support member 10 is formed from a single blank 11 of foldable sheet material (e.g., double-faced corrugated fiberboard). The blank includes a top panel 12 which preferably has a square or rectangular configuration. The top panel should be of such size as to provide adequate support for the object L. Foldably connected to opposed peripheral segments 12*a* of top panel 12 ia a pair of side walls 13 which depend at right angles to the top panel when the blank is set up. Disposed on opposite sides of the side walls 13 and foldably connected thereto is a pair of intermediate panels 14 which are disposed in spaced relation beneath the top panel when the blank is set up. The intermediate panels 14 are adapted to assume edge-to-edge substantially coplanar relation. Connected by a foldline 15 to the outer edge of each intermediate panel 14 is a base panel 16, as seen more clearly in FIG. 1. When the blank 11 is set up, the base panels are arranged in edge-to-edge coplanar relation and subtend the intermediate panels 14 as seen more clearly in FIGS. 4–6.

Foldably connected to opposed second peripheral segments 12*b* of the top panel 12 is a pair of tuck flaps 17. Each flap includes inner and outer portions 17*a* and *b* which are separated from one another by a foldlne 18. Peripheral segments 12*b* are disposed intermediate peripheral segments 12*a*. When the blank 11 is fully set up, the inner portion 17*a* of each flap 17 will depend from the top panel 12 and the outer portion 17*b* will be frictionally retained in sandwiched relation between the intermediate and base panels 14 and 16, see FIGS. 4 and 6. It will be noted that the outer edge of flap portion 17*b* at approximately its mid-length is provided with a notch 17*c*. Each notch is adapted to interlockingly engage corresponding notches 15*a* formed at the opposite ends of foldines 15, see FIG. 1. When the notches 15*a* and 17*c* are in interlocking relation, the blank 11 will be retained in its fully set-up condition without the need for staples, adhesives, tapes or the like. Furthermore, setting up the blank does not require any tools or special equipment and may be readily performed manually.

Figure 6:
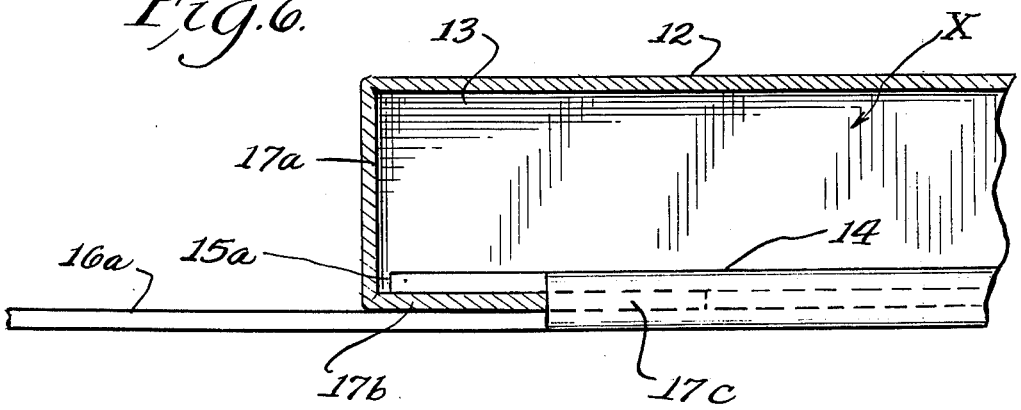
FIG. 6 is an enlarged, fragmentary, sectional view taken along line 6—6 of FIG. 5.

As noted in FIG. 6, when the blank is fully set up, the top panel 12, side walls 13, flap portions 17*a* and the intermediate panels 14 cooperate with one another to form a compartment X, which may, desired, accommodate the lamp cord, or harp and finial for the lamp base.

When the object L is resting upon the top panel 12, as seen in FIG. 5, the lamp base may be encompassed by a sleeve, not shown, which rests upon the marginal portions 16*a* of the base panels 16 which extend lateral beyond the exterior of the compartment. The sleeve would be suitably supported so as to maintain the base in a spaced relation with the interior of the shipping container C.

Referring now to FIGS. 7, 8, 9, 10, a second form of the improved support member 110 is shown. The support member is similar to the first form except that intermediate panels 114 and base panels 116 are of shorter length so as not to abut along foldlines 115 when the support member is set up as in FIG. 9. In this configuration the base panels 116 interply with minor closure flaps 118 formed at the bottom of the conventional shipping container C so as to assure the proper spacing of the support member 110 with respect to the side walls of the shipping container C. Once the minor flaps 118 have been folded inwardly so as to coact with the support member 110 in a manner to be hereafter described, the major closure flaps 119 of the container C are folded inwardly so as to subtend the minor flaps and the support member.

Support member 110 is formed from a single blank 111 as shown in FIG. 7. Blank 111 is similar to blank 11 and corresponding parts have been given the same number but in the one hundred series. In blank 111 the foldline connections 115 between the intermediate panels 114 and the base panels 116 do not abut one another, when the blank is set up to form the support member 110, but instead are disposed in spaced coplanar relation as seen more clearly in FIG. 9. In addition, base panels 116 are relatively narrow as compared to panels 16 of blank 11 and do not extend laterally to the side walls of the container C to which the minor closure flaps 118 are connected. It will be noted in FIG. 7 that blank 111 has been modified along the outer portion 117*b* of each tuck flap 117 so as to provide a pair of longitudinally spaced notches 117*c* which are adapted to frictionally interlock with corresponding notches 115*a* formed at the ends of foldlines 115. When notches 115*a* and 117*c* are in interlocking relation, the blank 111 will be retained in its fully set-up position.

To achieve proper support member placement within container C, blank 111 is initially folded along all foldlines, except 115, in a manner as described relative to blank 11. Prior to panels 116 being folded about foldlines 115, the minor closure flaps 118 of the container C are folded inwardly relative to the container side walls so that the flaps 118 engage and subtend the prefolded tuck flap portions 117*b* and panels 114 of the partially set-up blank 111. The distance each foldline 115 is from the corresponding container side wall to which the closure flap 118 is connected is substantially the same as the width of the closure flap. Subsequent to the minor closure flaps subtending the panels 114, the panels 116 are folded laterally outwardly so as to sandwich each minor closure flap 118 between corresponding panel 116 and tuck flap 117 of the set-up blank 111, see FIG. 10. The container major flaps 119 are then folded so as to close the bottom of the container and lock the support member 110 in position within the container. The folded major closure flaps are secured in place by adhesive, tape or the like. The length of each base panel 116 is preferably the same as the distance between the container side walls to which the major closure flaps are connected.

A third form of support member 210 is shown in FIG. 12 which is adapted to have a substantial portion thereof elevated relative to the bottom of the shipping container, not shown. Support member 210 is similar in many respects to support member 10 and, thus, corresponding portions are identified by like numerals except in a two hundred series. The blank 211, from which support member 210 is formed, differs from blank 11 in that a pair of like panel sections 216*a* are foldably connected by foldlines 290 to opposite edges of each panel 216, and a third panel section 216*b* is foldably connected by a foldline 291 to an intermediate edge of said panel.

In setting up blank 211 to form the support member 210, the same folding procedure is followed as that previously described with respect to blank 11. In addition to the previously described folding steps, panel sections 216*a* disposed at opposite sides of the support member 210 may be folded upwardly (as seen in FIG. 12) or downwardly relative to the plane of base panels 216. In a similar fashion, panel sections 216*b* are folded downwardly as shown, or upwardly. The depending panel sections will rest upon the bottom of the shipping container, thereby positioning the remainder of the support member in an elevated relation with respect to the container bottom. The area delimited by the folded panel sections corresponds substantially to the cross-sectional area of the container interior.

In instances where the product, or article, accommodated within the shipping container has a low profile, the shipping container accordingly may have a lower elevation in which case the upwardly folded panel sections and the downwardly folded panel sections would simultaneously engage the top and bottom, respectively, of the container, thereby retaining the remainder of the support member in a properly spaced position within the container interior.

Thus, it will be seen that a simple, inexpensive, and sturdy support member has been provided which may be readily set up without requiring tools or special equipment. The support member is formed from a single blank which may be stored in a collapsed state.

We claim:

1. A support member formed of foldable sheet material for supporting an object, comprising a pair of base panels disposed in substantially coplanar relation; a pair of intermediate panels overlying said base panels and having corresponding peripheral portions foldably connected to said base panels; side wall panels foldably connected to said intermediate panels and extending angularly relative to the plane of said base panels; a top panel for engaging and subtending the object and being disposed in spaced overlying relation with respect to said intermediate panels and being foldably connected to corresponding peripheral portions of said side walls; and at least one tuck flap foldably connected to said top panel and having a first portion interposed between said intermediate panels and the plane of said base panels and frictionally held therebetween, and a second portion foldably interconnecting said first portion and said top panel and being angularly disposed relative thereto.

2. The support member of claim 1 wherein the foldable connections between the base panels and the intermediate panels are provided with a first locking means, and the tuck flap is provided with a complemental second locking means in interlocking relation with said first locking means.

3. The support member of claim 1 including a pair of tuck flaps foldably connected to spaced peripheral segments of said top panel.

4. The support member of claim 3 wherein the foldable connections between the base panels and the intermediate panels are provided with first locking means, and each tuck flap is provided with complemental second locking means in interlocking relation with said first locking means.

5. The support member of claim 3 wherein said intermediate panels, said tuck flaps, said side walls and said top panel cooperate to form a compartment.

6. The support member of claim 1 wherein said coplanar base panels define an area having marginal portions extending laterally beyond the perimeter of said top panel.

7. The support member of claim 1 wherein said base panels are disposed in edge-to-edge relation and said intermediate panels are disposed in edge-to-edge coplanar relation and in substantially parallel relation with respect to said base panels.

8. The support member of claim 7 wherein said top panel is disposed in substantially parallel relation to said intermediate and base panels.

9. The support member of claim 1 being formed from a single blank of sheet material.

10. The support member of claim 1 wherein foldlines connecting corresponding intermediate and base panels are disposed in spaced substantially parallel relation.

11. The support member of claim 1 wherein each base panel includes foldable peripheral sections disposed in angularly folded relation relative to the plane defined by said coplanar base panels.

12. A blank of foldable sheet material for use in forming a support member for an object, said blank comprising a top panel for subtending and engaging the object; side walls foldably connected to opposing first peripheral segments of said top panel, a pair of intermediate panels disposed on opposite sides of said top panel and foldably connected to said side walls whereby said intermediate panels are adapted to subtend in spaced relation said top panel; a pair of base panels disposed on opposite sides of said top panel and foldably connected to said intermediate panels whereby said base panels are adapted to subtend and be substantially parallel to said intermediate panels; and a tuck flap foldably connected to a second peripheral segment of said top panel disposed intermediate said first peripheral segments; the length of said tuck flap measured parallel to the folding connection thereof to the top panel not exceeding the spacing separating the folding connections between the top panel and said side panels whereby said tuck flap is sandwiched between the intermediate panels and the base panels when the blank is set up to form the support member.

13. The blank of claim 12 including a pair of tuck flaps disposed on opposite sides of said top panel and being foldably connected to second peripheral segments of said top panel; said second peripheral segments being disposed intermediate the first peripheral segments of said top panel.

14. The blank of claim 13 wherein the opposite ends of each foldable connection between the corresponding intermediate panel and the base panel terminate at elongated open-end first notches, and each tuck flap is provided with an open-end second notch, corresponding first and second notches being adapted to interlock with one another when said blank is set up to form the support member.

15. The blank of claim 14 wherein each tuck flap includes a first portion foldably connected to the second peripheral segment of the top panel, and a second portion foldably connected to said first portion, said second portion being provided with an open-end second notch.

16. The blank of claim 12 wherein each base panel includes a plurality of peripheral panel sections connected by foldlines to said base panel; one of the latter foldlines being in spaced substantially parallel relation with the folding connection between the base panel and the corresponding intermediate panel, the other of the latter foldlines being angularly disposed relative to the said one of the latter foldlines.

* * * * *

UNITED STATES PATENT AND TRADEMARK OFFICE

CERTIFICATE OF CORRECTION

PATENT NO. : 4,030,604

DATED : June 21, 1977

INVENTOR(S) : Larry R. Hildebrand and John F. Carpenter

Figure 1:
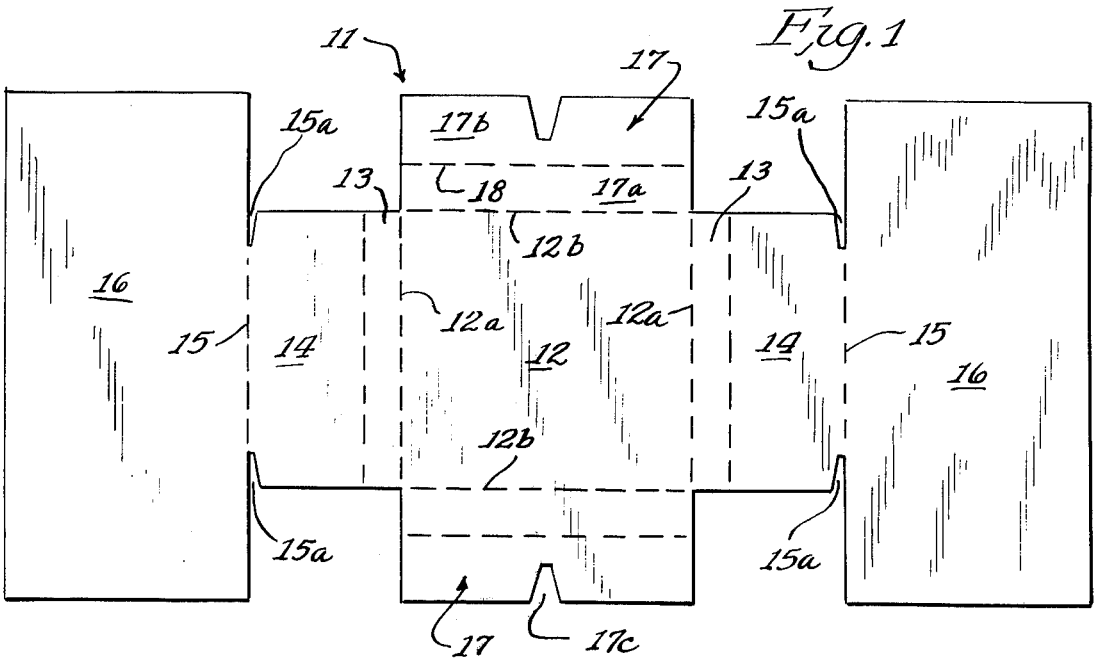
FIG. 1 is a plan view of one form of a blank for use in setting up one embodiment of the improved support member.
Figure 2:
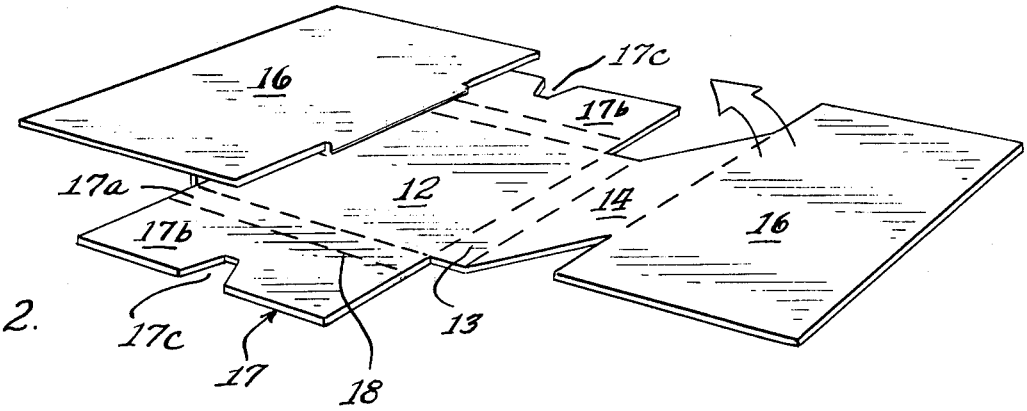
FIGS. 2 and 3 are perspective views showing the blank of FIG. 1 successive stages of set-up.
Figure 3:
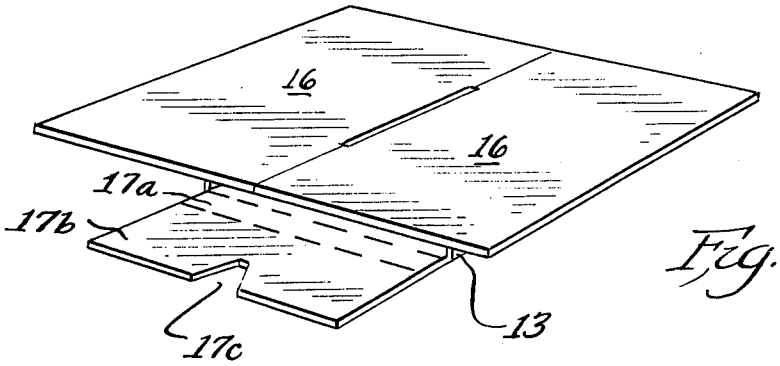

It is certified that error appears in the above-identified patent and that said Letters Patent are hereby corrected as shown below:

Column 2, line 2 - after "FIG. 1" insert -- in -- line 4 - after "is" insert -- a -- line 45 - change "ia" to -- is -- line 61 - "foldlne" should be -- foldline --

Column 3, line 14 - after "which may," insert -- if -- line 19 - "lateral" should be -- laterally --

Signed and Sealed this

*Fourth* Day of *October 1977*

[SEAL]

*Attest:*

RUTH C. MASON
*Attesting Officer*

LUTRELLE F. PARKER
*Acting Commissioner of Patents and Trademarks*